US006459799B1

(12) United States Patent
Smits

(10) Patent No.: US 6,459,799 B1
(45) Date of Patent: Oct. 1, 2002

(54) MODULARLY EXPANDABLE ELECTROSTATIC SPEAKER SYSTEM

(75) Inventor: Maarten Smits, Bennekom (NL)

(73) Assignee: Final Cia BV, Ede (NL)

( * ) Notice: Subject to any disclaimer, the term of this patent is extended or adjusted under 35 U.S.C. 154(b) by 0 days.

(21) Appl. No.: 10/038,121

(22) Filed: Jan. 2, 2002

(51) Int. Cl.[7] ..... H04R 25/00

(52) U.S. Cl. ..... 381/191; 381/300; 381/307; 381/116

(58) Field of Search ..... 381/17, 18, 19, 381/124, 300, 303, 304, 305, 307, 308, 116, 182, 186, 191

(56) References Cited

U.S. PATENT DOCUMENTS

| | | | | |
|---|---|---|---|---|
| 1,844,219 | A | | 2/1932 | Greaves |
| 3,668,336 | A | | 6/1972 | Wright |
| 4,122,302 | A | | 10/1978 | Bobb |
| D302,979 | S | | 8/1989 | Sanders |
| 5,369,701 | A | | 11/1994 | McAteer et al. |
| 5,392,358 | A | | 2/1995 | Driver |
| 5,533,129 | A | * | 7/1996 | Gefvert ..... 381/300 |
| 6,035,962 | A | | 3/2000 | Lin |
| 6,175,636 | B1 | | 1/2001 | Norris et al. |
| 6,188,772 | B1 | | 2/2001 | Norris et al. |

* cited by examiner

*Primary Examiner*—Huyen Le
(74) *Attorney, Agent, or Firm*—Larson & Larson, P.A.; James E. Larson

(57) ABSTRACT

An non-hybrid electrostatic speaker system is provided. Each electrostatic speaker contains a diaphragm positioned between pair of electrically charged stators. A central unit is provided having a plurality of slots for receiving a plurality of printed circuit boards. Each speaker employed within the system has a printed circuit board assigned thereto and is mounted within the central unit slots. A single DC power source within the central unit supplies a constant DC voltage to each electrostatic speaker. All electronics needed to operate the speakers are "de-coupled" from the speaker and located within the central unit. The central unit couples to an audio amplification device which is coupled to an audio sound producer.

20 Claims, 5 Drawing Sheets

MODULARLY EXPANDABLE ELECTROSTATIC SPEAKER SYSTEM

BACKGROUND OF THE INVENTION

1. Field of the Invention

This invention relates to electrostatic speakers. More particularly, it relates to a modular, non-hybrid electrostatic speaker system wherein the electronic circuitry, including the power transformer, is removed from the cabinetry of the speaker housing and enclosed within a central unit wherein a single printed circuit board is employed for each electrostatic speaker employed within the system.

2. Description of Prior Art

Electrostatic loudspeakers, also known as capacitor loudspeakers, are well known in the prior art. Electrostatic speakers work on a physical principle quite different than that of cone and dome style speaker. Electrostatic speakers employ an ultra-thin layer of electrically charged conductive film (the diaphragm) sandwiched between two metal grids or stators along with a set of spacers. The spacers provide the diaphragm with a fixed distance in which to move backwards and forwards between the stators. A DC power supply coupled to each speaker supplies a substantially constant charge to the stators such that when an amplifier sends an audio signal to the speaker, the signal changes into a high voltage signal which are applied to the stators being equal in strength but opposite in polarity. As signals are applied to the stators, the resulting electrostatic field works conjunctively with and against the diaphragm to move it back and forth thereby moving air particles which the human ear detects as the audio signal emanating from the audio source.

Known prior art electrostatic speakers are known as "hybrid" speakers since they usually employ a cone or dome style speaker driver along with the electrostatic driving element. This has been done since a typical electrostatic speaker is unable to produce low-end audio frequencies, such as, for example, those frequencies below 150 Hz. As shown in U.S. Pat. No. 4,122,302, a typical electrostatic speaker system is disclosed wherein a dynamic speaker (cone driver) is employed in combination with the electrostatic speaker element. This "hybrid" style represents a deficiency in the prior art since some form of crossover circuitry must be employed within the electrostatic cabinetry to direct the appropriate audio frequencies to either the dynamic driver or the electrostatic element. This takes away from one of the main advantages of an electrostatic speaker in that it can not be made to be generally planar in shape. Some form of box-like cabinetry must be employed with the electrostatic element to house the crossover circuitry and the dynamic driver. In most cases, this eliminates, or at least limits, the ability to mount an electrostatic speaker to a wall. What is needed is a completely planar electrostatic speaker housing that lacks any box-like housing so that it could be mounted to a wall surface, much like a flat plasma TV screen can be mounted to a wall as compared to a traditional CRT TV set. It is understood that most electrostatic speakers are referred to as being "generally" planar, however some do employ a convexed-shaped, faceted, or curved stator assembly, for example, like those produced by the company MartinLogan™. What is meant by "generally" planar, is that the overall housing of the speaker is generally flat as compared to the square or rectangular shaped housings which encloses cone or dome style drivers. These housing require a substantial amount of depth to enclose the magnetic voice coil and cone-shaped driver.

As stated before electrostatic speakers employ a power supply for each electrostatic speaker within a system. This is done to "charge" the stators and create the electrostatic field which acts to move the diaphragm back and forth. The need for each electrostatic speaker to have its own power supply is an inherent disadvantage in the prior art which needs to be improved upon. Typically, prior art electrostatic speakers are provided with an AC plug coupled to a 12 volt DC converter. Accordingly, each electrostatic speaker must be setup in close proximity to an AC socket or attached to a multi-plug AC power strip which in turn is plugged into an AC socket. In either case, locating the electrostatic speaker can become more dependent on the location of its needed power source instead of its optimal acoustical positioning. Due to the inherent unidirectional sound dispersion characteristics of electrostatic speakers, location is often critical to the sound reproduction. A so called "sweet spot" is often created in an electrostatic speaker system which is not considered as critical of a factor as that of the more inherent omnidirectional dispersion characteristics of cone or dome style driving speakers. Therefore, the dependency upon the location of the power source has been a major deficiency in prior art electrostatic speakers and systems; one which needs improvement.

It is clear from the prior art, that major inherent deficiencies and disadvantages exist for known electrostatic speakers that warrant improvement thereupon. First, there is clearly a need to provide for a non-hybrid electrostatic speaker. This would eliminate the need for additional housings to be employed with the generally planar electrostatic speaker since no cone drivers would be employed. There is a further need to "de-couple" the electronic circuitry from the electrostatic speaker thereby permitting for ideal acoustical positioning. Centrally locating all electronics for a given electrostatic speaker system would also represent an improvement in the prior art. Still further, providing a single power source for all of the speakers of an electrostatic speaker system would greatly improve the ability to locate the speakers for both acoustical ("sweet spot") and aesthetic purposes. And since surround sound is a greatly desired feature of most audio systems of today, an electrostatic speaker system which permits for additional speakers to be added with great ease, such as in a modular fashion, would also be a great advancement in the prior art of electrostatic speakers and systems. Further, the ability to add a non-hybrid center channel electrostatic speaker would be an advancement in the prior art since none are known to exist therein.

SUMMARY OF THE INVENTION

I have invented a modularly expandable electrostatic speaker system which greatly improves upon known prior art electrostatic speakers and systems. Each electrostatic speaker within my novel system is a non-hybrid, purely electrostatic speaker. Hence, there are no magnetically driven cone or dome style drivers utilized with my electrostatic speakers. Each speaker employs a diaphragm made of an ultra-thin layer of electrically charged conductive film positioned between the stators which are separated by a set of spacers. The diaphragm, having a mass less than the air it moves, pulsates back and forth in response to the oppositely charged stators.

A constant charge is applied to the stators of each speaker from a single power supply within a central unit. Also within the central unit, coupled to an A/V receiver or amplifier (which in turn is coupled to an audio source), are a series of slots which receive a plurality of printed circuit boards (PCB). There is one PCB for each electrostatic speaker employed within the system. The single power supply employed within the central unit supplies power to all of the electrostatic speakers of the system. There is no need in my system to supply power to each speaker with a separate power source (i.e., AC adapter plugged into a wall socket for each speaker) as in known prior art electrostatic speakers. Power is supplied to each speaker in my system through a single cable coupled between the central unit and each speaker which also happens to carry the audio signal. Of course the power source cable is well shielded from the audio signal cable to eliminate any potential interference there between.

Since my system is modularly expandable, the system can employ two speakers to five speakers (i.e., front left and right, center, rear left and right) in the preferred embodiment. In alternate embodiments, my system could actually employ even more speakers (i.e., a six speaker system wherein a center rear is employed). It is of course understood that my system can also employ a subwoofer which is coupled directly to the A/V receiver (controller) or amplifier. My novel electrostatic speakers, along with the central unit, are therefore capable of decoding and thereby producing audio sources encoded with any of the known surround sound technology, such as, for example, Dolby®, DTS® and THX 5.1®.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
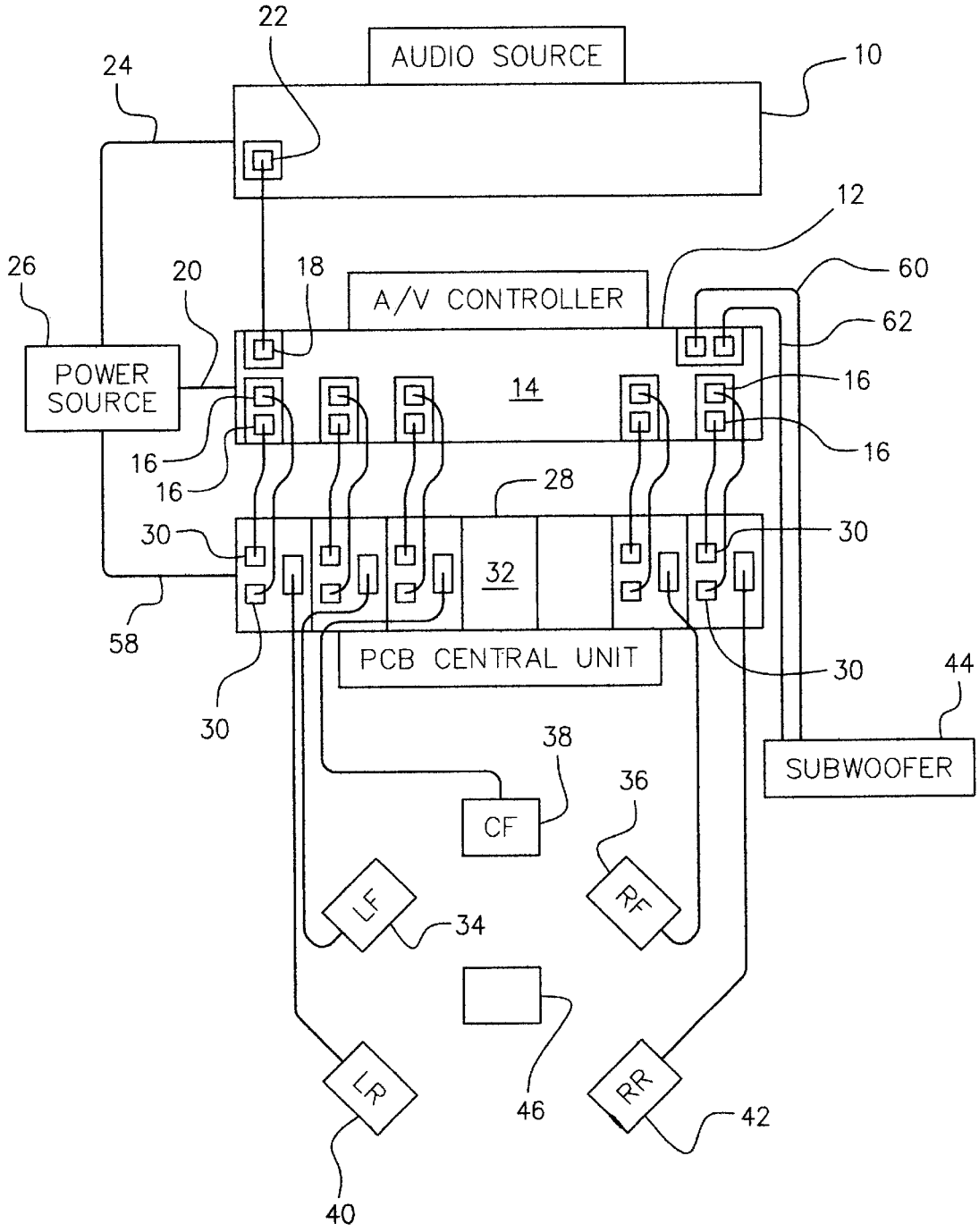
FIG. 1 is a graphical representation of the preferred embodiment of an electrostatic speaker system of the present invention and how it interconnects through a novel central unit.

Throughout the following detailed description, the same reference numerals refer to the same elements in all figures.

Referring to FIG. 1, an illustration is shown depicting a preferred embodiment of a modularly expandable electrostatic speaker system of the present invention. As shown, an audio source 10 is coupled to an audio/video (AV) controller 12. Audio source 10 can be any known audio sound producer, such as, for example, a CD player, a DVD player, a Mini Disc® player, a laser disc player, a cassette player, a phono-record player, a computer or any other emerging audio sound producing unit known in the art. AV controller 12 can be any known receiver or power amplifier capable of amplifying the audio signal produced by audio source 10 by a fixed or variable rate. AV controller 12 has a back side 14, wherein a plurality of speaker connection posts 16, at least one audio signal input 18, and a power connection 20 to a power source 26, such as, for example, an AC socket are provided. Audio source 10 is of course provided with at least one audio signal output 22 and its own power connection 24 to the power source 26. The audio signal output 22 of audio source 10 can be any known audio signal output, such as, for example, an analog mono or stereo RCA plug, mini plug or ¼" plug type output, an optical output, a SPD/IF digital co-axial output, a computer USB port, a digital FireWire® output or any other known or emerging audio signal output connection protocol.

With continuing reference to FIG. 1, it is shown that a central unit 28 is provided which couples each speaker connection post 16 of A/V controller 12 to a reciprocal connector 30 on a back panel 32 of central unit 28. In accordance therewith, each positive lead of each speaker connection post 16 on A/V Controller back side 14 (for a given speaker) connects to the reciprocal positive lead of speaker connection post 30 on central unit back panel 32, and each negative lead of each speaker connection post 16 lead from A/V Controller back side 14 connects to the reciprocal negative lead of speaker connection post 30 on central unit back panel 32 (for the same given speaker). Central Unit 28 has a single power supply (not shown) enclosed therewithin. A power connection 58 of central unit 28 connects to power source 26.

Figure 3:
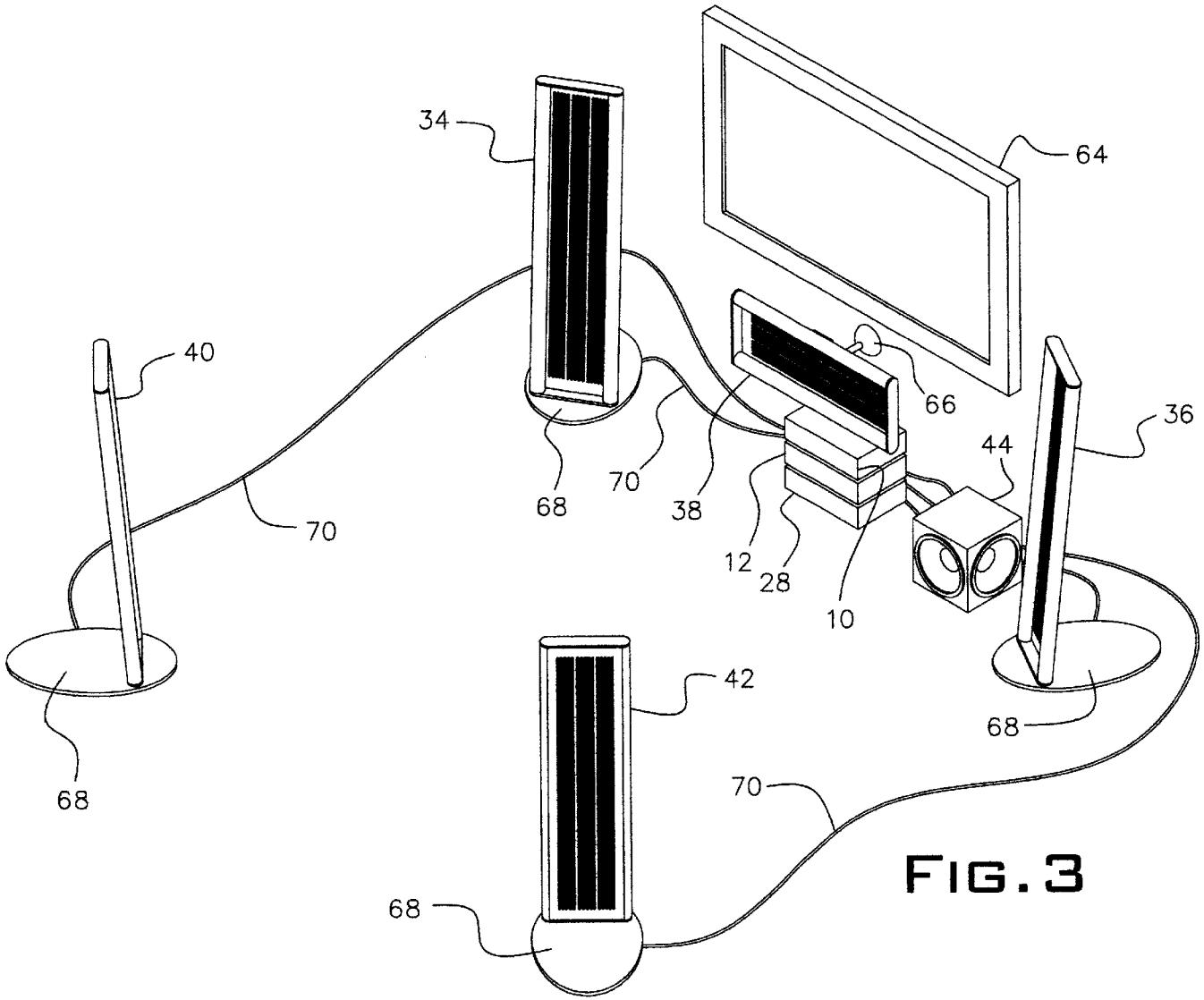
FIG. 3 is perspective view of a room utilizing the electrostatic speaker system of the present invention.

As shown in FIGS. 1 and 3, five electrostatic speakers are employed with the system and represents a "Home Theater" system (the preferred embodiment). The system includes a left front (LF) speaker 34, a right front (RF) speaker 36, a center front (CF) speaker 38, also known as a center channel, a left rear (LR) speaker 40 and a right rear (RR) speaker 42. Also shown is a subwoofer 44, however this speaker device is not an electrostatic speaker. Subwoofer 44 is not required but is frequently used in surround sound systems (Home Theater) and is therefore illustrated herein. It is understood, as previously set forth, that the novel subject invention of electrostatic speakers are non-hybrid speakers. None of the speakers 32, 34, 36, 38, 40 or 42 employ any type of cone or dome style magnetic coil driver. Speakers 32, 34, 36, 38, 40 and 42 are pure electrostatic technology. However, as depicted n FIG. 3, subwoofer 44 employs magnetic cone drivers wherein a pair of cone drivers positioned at a ninety degree angle from one another are employed and are forward firing.

Further to FIG. 1, a sweat spot 46 is depicted which would commonly be some form of sitting apparatus such as, for example, a chair or couch. Although there is no requirement that a listener of the subject electrostatic speaker system sit in the sweat spot 46, full enjoyment of any speaker system is typically best when someone sits directly or within very close proximity of this so called "sweet spot". Nothing herein, however, limits the use of the electrostatic speaker system of the present invention wherein the positioning of the speakers is determined solely for listening to the audio source in or near the sweet spot 46.

Figure 2:
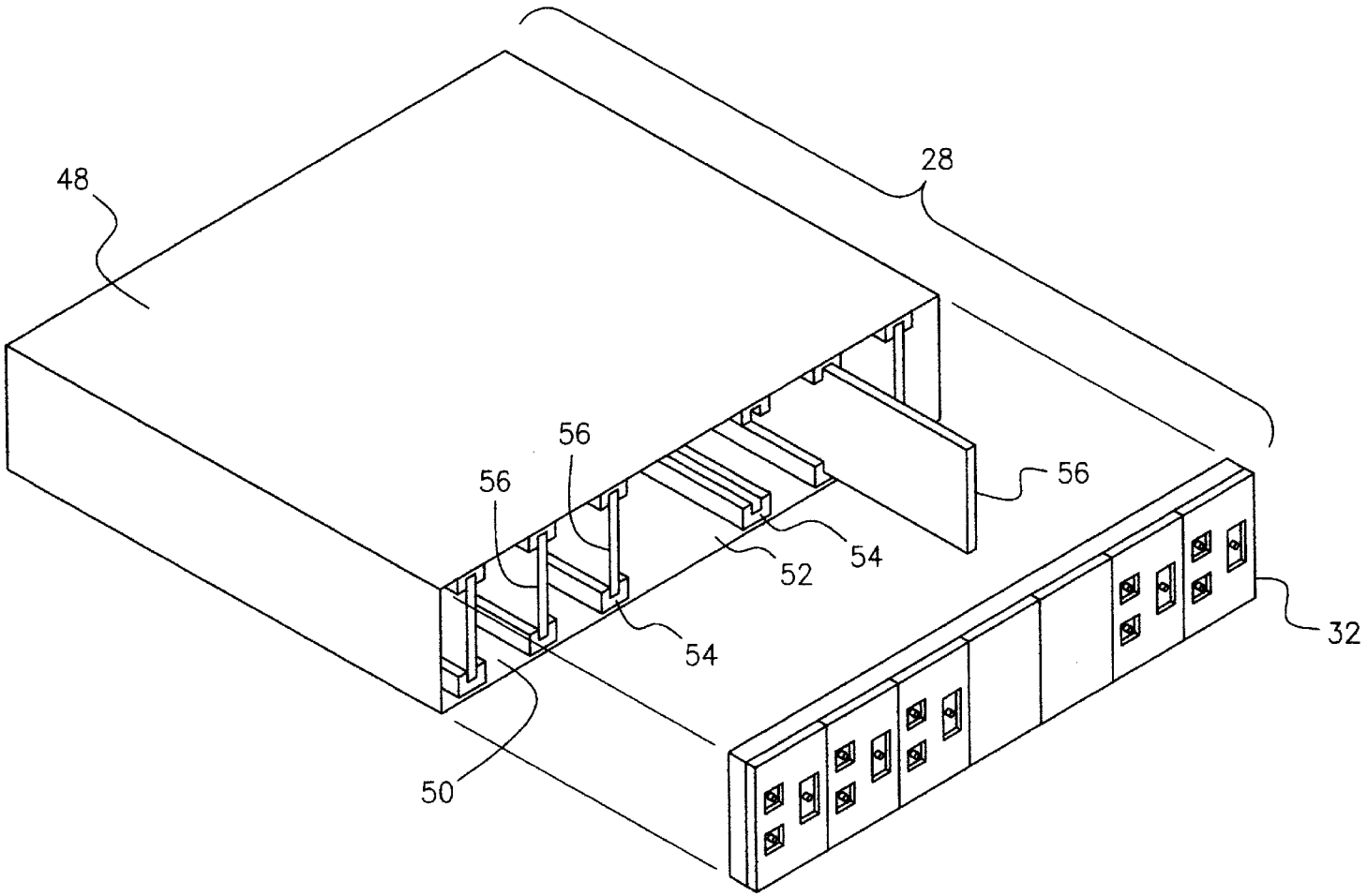
FIG. 2 is a partially exploded view of the central unit depicting how printed circuit boards for each electrostatic speaker slide in and out of slots in the central unit.

Referring to FIG. 2, central unit 28 includes a generally rectangular housing 48 and the back panel 32 which covers an opening 50 to an inner cavity 52. Positioned parallel along the length of housing 48 within cavity 52 are a plurality of slots 54. In the preferred embodiment six slots 54 are employed, although nothing herein limits the use of more or less than six slots. Each slot 54 can receive a printed circuit board (PCB) 56 which is dedicated (assigned) to a specific electrostatic speaker within the system. Accordingly, if only a pair of front speakers are employed with an audio system, then only two PCBs 56 would be needed. In the preferred system, wherein five speakers are employed, five PCBs 56 are employed, as depicted in FIG. 2. Each PCB 56 has a connector portion (not shown) which engages a motherboard (also not shown) along an inner front side of housing 48. No PCB is used for the subwoofer 44 since its connection to A/V Controller 12 is not coupled through central unit 28 but is coupled directly to A/V Controller 12 (as shown in FIG. 1) with a pair of connection lines 60 and 62.

Referring to FIG. 3, a Home Theater, preferred system, is depicted wherein five electrostatic speakers are employed, 34, 36, 38, 40 and 42, subwoofer 44, central unit 28, A/V Controller 12 and audio source 10. It is further shown that the system could be used with a video screen 64, such as, for example, a flat plasma screen display. In this system, as stated before, five PCBs 56 would be inserted within central unit 28. As also shown in FIG. 3, center front (CF) speaker 38 can be mounted to a wall surface by a bracket 66 (also shown in FIG. 5). Left front (LF) speaker 34 and right front (RF) speaker 36 could also be mounted in this manner although it is not shown herein. In fact, any or all of the five electrostatic speakers 34, 36, 38, 40 and 42 could be mounted by a bracket 66 as shown with front center (FC) speaker 38 in FIGS. 3 and 5.

Figure 4:
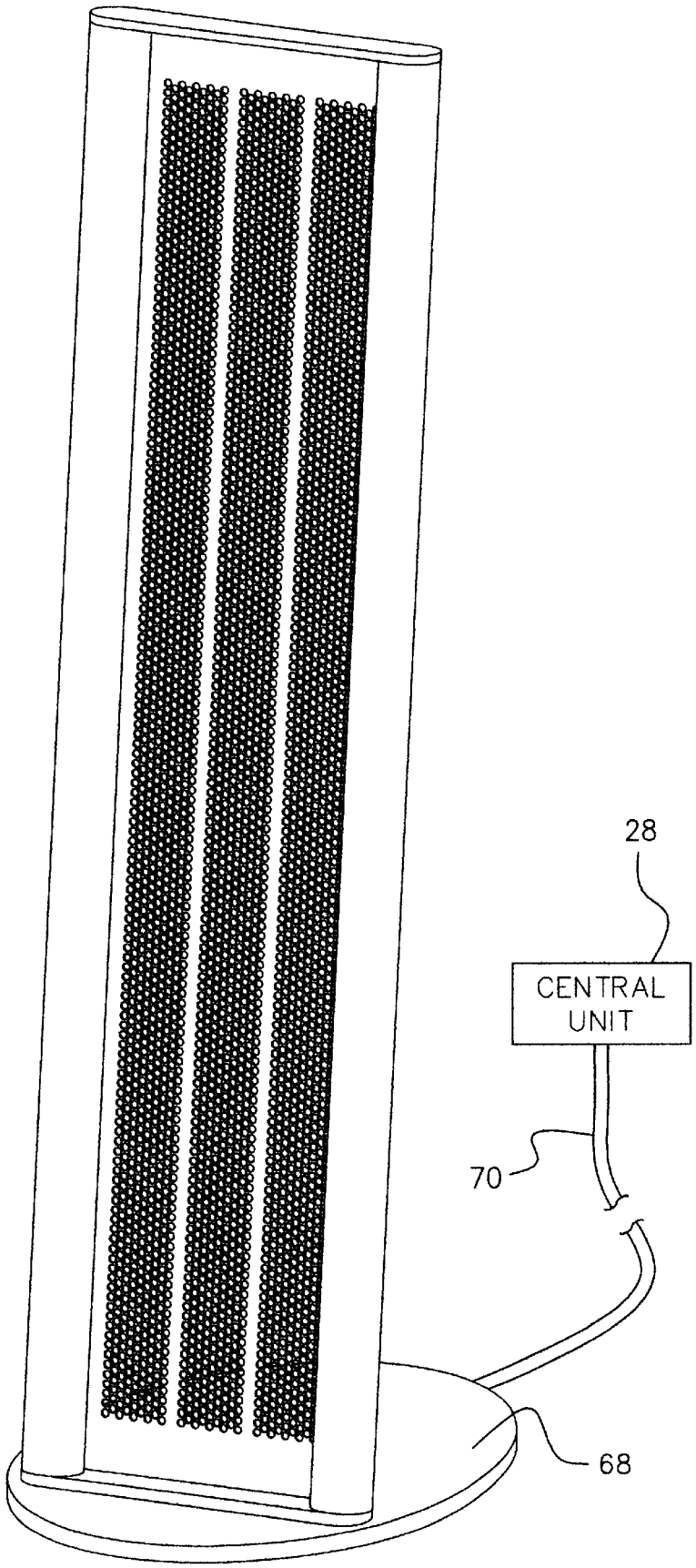
FIG. 4 is a perspective view of one electrostatic speaker of the present invention wherein a base member is employed to set the speaker on a floor.

With continuing reference to FIG. 3, it is shown that if a bracket is not employed to stabilize the speaker, then the speaker employs a base member 68 (also clearly shown in FIG. 4). Base member 68 can be any shape, but in its preferred form is oval shaped.

Figure 5:
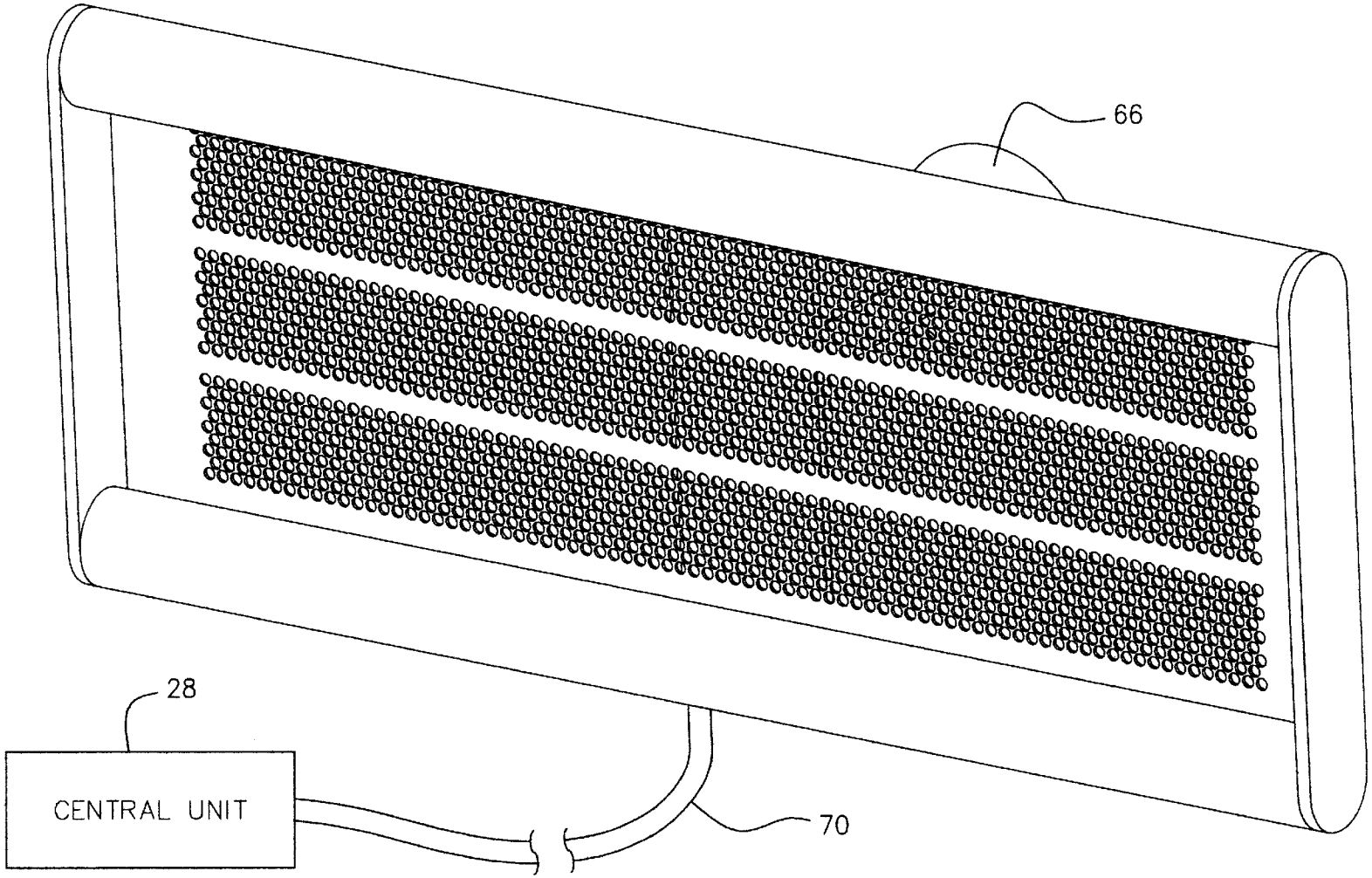
FIG. 5 is a perspective view of one electrostatic speaker of the present invention wherein a bracket is employed to mount the speaker to a wall.

With reference to FIGS. 4 and 5, it is shown that each speaker is connected to central unit 28 by a single wire which encloses the negative and positive speaker leads as well as the 12v DC power connection.

As set forth above, a motherboard is mounted within the cavity 52 of central unit housing 48 along an inner front side thereof. The motherboard is positioned in a perpendicular relationship with each slot 54 such that connection points along an end portion of each PCB 56 can engage the motherboard thereby providing a signal path from each PCB to the motherboard. The motherboard employs all of the necessary filters, audio transformers and the power supply. As mentioned before, this single power supply located on the motherboard provides the necessary 12 v DC power for each and every electrostatic speaker within the system. The single power supply is powered by a connection to an AC socket through a 12 Vac, 10 watt adapter. There is no need in the present invention to connect each electrostatic speaker to a power source through its own dedicated transformer as practiced in the prior art.

In the preferred embodiment, the stators used in each electrostatic speaker are flat and not convex-shaped as many electrostatic speakers employ in the prior art. The vibrating diaphragm, which is lighter than the air it moves, includes a thin PET (polyethyleneterethalate) film filled with a carbon polymer material. This combination of materials helps in eliminating charge displacement, which can eventually lead to electric breakdown, as compared to those prior art speakers which use a graphite layer sandwiched between a thin film sheet.

In the preferred embodiment, a toroidal step-up audio transformer is used having nickel-alloy tape cores for obtaining extreme bandwidth response along with an air gap for lowering distortion output. To reduce the leakage of inductance, a minimal amount of turns are employed in the high-permeability core along with extremely thin wire which reduces the build of the coil of the transformer. To minimize capacitance, a Teflon® isolation material is employed which increases the dielectric thickness of the air bubble.

Although not shown, an alternate embodiment of the present invention would include a system which incorporates the central unit within the A/V Controller. This would eliminate the need for two separate devices and the connections as illustrated in FIG. 1 and described hereinabove. In such alternate embodiment, the central unit would be part of the A/V Controller and access would be provided for expanding the speaker system by adding the necessary PCBs which expand the number of speakers that can be used.

Further, although not shown, a center rear speaker could be employed in the present system. In such an arrangement, a sixth speaker would be placed between left rear (LR) speaker 40 and right rear (RR) speaker 42 such that this center rear speaker would be located directly behind the head of a listener is she were sitting in the sweat spot 46 depicted in FIG. 1. And of course, an additional PCB 56 would be employed within central unit 28 along with the required connection line 70 between central unit 28 and the speaker Equivalent elements can be substituted for the ones set forth above such that they perform the same function in the same way for achieving the same result.

Having thus described the invention what is claimed and desired to be secured by Letters Patent is:

1. A modularly expandable electrostatic speaker system coupled to an audio amplification device for reproducing an audio signal directed through the audio amplification device and out to the modularly expandable electrostatic speaker system, the speaker system comprising:

a) a plurality of electrostatic speakers, each electrostatic speaker of the plurality including a frame network supporting a front and back stator and a diaphragm positioned between the stators, the stators receiving electrical charges of opposing polarity for causing the diaphragm to vibrate in a forward and backward direction, the diaphragm moving air and thereby reproducing the audio signal, b) a central unit coupled between the audio amplification device and the plurality of electrostatic speakers, the central unit including a housing, a plurality of slots positioned within the housing along a length thereof, a main circuit board mounted within the housing at a distal end of the plurality of slots and a back panel enclosing the plurality of slots and main circuit board within the housing, the back panel having a plurality of modules whereby each module is associated with a particular slot and includes a positive and negative speaker lead for connecting to reciprocal positive and negative speaker leads on the audio amplification device, and a single wire connector for coupling to an electrostatic speaker of the system, the back panel mounted to the housing at a proximal end of the plurality of slots, c) a plurality of cables, each cable coupled to an electrostatic speaker and one of the single wire connectors of the plurality of modules of the central unit back panel, each cable carrying a positive and negative signal representative of the audio signal produced from the audio amplification device and a DC voltage source to the electrostatic speaker coupled thereto, d) a single power supply mounted within the central unit for supplying a DC voltage source for each electrostatic speaker employed within the system, and e) a plurality of printed circuit boards inserted within the plurality of slots, each printed circuit board of the plurality associated with a particular electrostatic speaker of the system, each printed circuit board engaging the main circuit board at a distal end thereof and further engaging a module connector located behind each central unit back panel module at a proximal end thereof such that each positive and negative speaker lead and the single wire connector of each module communicates with the printed circuit board through the module connector.

2. The modularly expandable electrostatic speaker system of claim 1, wherein two electrostatic speakers are employed.

3. The modularly expandable electrostatic speaker system of claim 1, wherein five electrostatic speakers are employed such that a first speaker is positioned as a left front speaker, a second speaker is positioned as a right front speaker, a third speaker is positioned as a center front speaker, a fourth speaker is positioned as a left rear speaker and a fifth speaker is positioned as a right rear speaker.

4. The modularly expandable electrostatic speaker system of claim 1, wherein at least two speakers of the plurality of electrostatic speakers further include a base member attached at a bottom end of the frame network for supporting the speakers on a planar surface.

5. The modularly expandable electrostatic speaker system of claim 1, wherein at least one speaker of the plurality of electrostatic speakers is mounted to a wall surface by a bracket.

6. The modularly expandable electrostatic speaker system of claim 1, wherein the diaphragm is constructed of a thin polyethyleneterethalate film filled with a carbon polymer material.

7. The modularly expandable electrostatic speaker system of claim 1, wherein the central unit employs six slots.

8. The modularly expandable electrostatic speaker system of claim 1, wherein the number of printed circuit boards employed within the central unit is equal to the number of electrostatic speakers employed within the speaker system.

9. The modularly expandable electrostatic speaker system of claim 1, wherein the central unit further includes a power cord for connection to an AC power source and a transformer for converting the AC power source to the DC voltage within the central unit.

10. The modularly expandable electrostatic speaker system of claim 1, wherein the connection between any of the electrostatic speakers of the system and the central unit is dependent on the connection between speaker location designations of the audio amplification device and the central unit.

11. The modularly expandable electrostatic speaker system of claim 1, wherein the stators are planar.

12. A modularly expandable non-hybrid electrostatic speaker system for producing an audio signal representation of an audio source emanating from an audio amplification device, the speaker system coupled to the audio amplification device, the speaker system and the audio amplification device deriving power from connection to an AC power source, the speaker system comprising:

a) a plurality of electrostatic speakers, each including a parallel-spaced frame network supporting a planar front and back stator and a planar diaphragm positioned between the front and back stators, the stators receiving electrical charges of opposing polarity for causing the diaphragm to vibrate in a forward and backward direction, the diaphragm moving air and reproducing the audio signal representation, b) a central unit coupled between the audio amplification device and the plurality of electrostatic speakers, the central unit including a housing, a plurality of slots positioned within the housing along a length thereof, a main circuit board mounted within the housing at a distal end of the plurality of slots, a power transformer and a removable back panel enclosing the plurality of slots and main circuit board within the housing, the back panel having a plurality of modules whereby each module is associated with a particular slot and includes a positive and negative speaker lead for connecting to reciprocal positive and negative speaker leads on the audio amplification device, and a single wire connector for coupling to an electrostatic speaker of the system, the back panel removably mounted to the housing at a proximal end of the plurality of slots, c) a plurality of cables, one for each electrostatic speaker employed within the system, each cable coupled between an electrostatic speaker and one of the single wire connectors of the plurality of modules of the central unit back panel, each cable carrying a positive and negative signal representative of the audio signal produced from the audio amplification device and a DC voltage source to the electrostatic speaker coupled thereto, d) a single power supply mounted within the central unit for supplying a DC voltage source to each electrostatic speaker employed within the system, and e) a plurality of printed circuit boards inserted within the plurality of slots, each printed circuit board of the plurality associated with a specific electrostatic speaker of the speaker system, each printed circuit board engaging the main circuit board at a distal end thereof and further engaging a module connector located behind each central unit back panel module at a proximal end thereof such that each positive and negative speaker lead and the single wire connector of each module communicates with the printed circuit board through the module connector.

13. The modularly expandable non-hybrid electrostatic speaker system of claim 12, wherein two electrostatic speakers are employed.

14. The modularly expandable non-hybrid electrostatic speaker system of claim 12, wherein five electrostatic speakers are employed such that a first speaker is positioned as a left front speaker, a second speaker is positioned as a right front speaker, a third speaker is positioned as a center front speaker, a fourth speaker is positioned as a left rear speaker and a fifth speaker is positioned as a right rear speaker.

15. The modularly expandable non-hybrid electrostatic speaker system of claim 12, wherein at least two speakers of the plurality of electrostatic speakers further include a base member attached at a bottom end of the frame network for supporting the speakers on a planar surface.

16. The modularly expandable non-hybrid electrostatic speaker system of claim 12, wherein at least one speaker of the plurality of electrostatic speakers is mounted to a wall surface by a bracket.

17. The modularly expandable non-hybrid electrostatic speaker system of claim 12, wherein the diaphragm is constructed of a thin polyethyleneterethalate film filled with a carbon polymer material.

18. The modularly expandable non-hybrid electrostatic speaker system of claim 12, wherein the central unit employs six slots.

19. The modularly expandable non-hybrid electrostatic speaker system of claim 12, wherein the number of printed circuit boards employed within the central unit is equal to the number of electrostatic speakers employed within the speaker system.

20. The modularly expandable non-hybrid electrostatic speaker system of claim 12, wherein a subwoofer is coupled to the audio amplification device.

* * * * *